US008523605B2

(12) United States Patent
Kobayashi

(10) Patent No.: US 8,523,605 B2
(45) Date of Patent: Sep. 3, 2013

(54) LOOP CONNECTOR AND CLOSED-CIRCUIT FORMING CONNECTOR

(75) Inventor: Kotaro Kobayashi, Fujisawa (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/321,456

(22) PCT Filed: May 20, 2010

(86) PCT No.: PCT/US2010/035601

§ 371 (c)(1),
(2), (4) Date: Nov. 18, 2011

(87) PCT Pub. No.: WO2010/135549

PCT Pub. Date: Nov. 25, 2010

(65) Prior Publication Data

US 2012/0071016 A1 Mar. 22, 2012

(30) Foreign Application Priority Data

May 20, 2009 (JP) ..... 2009-122039

(51) Int. Cl.
*H01R 31/00* (2006.01)

(52) U.S. Cl.
USPC ..... 439/510

(58) Field of Classification Search
USPC ..... 439/510, 512, 507
See application file for complete search history.

(56) References Cited

U.S. PATENT DOCUMENTS

| | | | | |
|---|---|---|---|---|
| 3,720,903 | A * | 3/1973 | Schor | 439/607.05 |
| 3,917,371 | A * | 11/1975 | Hirokawa et al. | 439/52 |
| 3,932,013 | A * | 1/1976 | Yeager et al. | 439/510 |
| 4,090,667 | A | 5/1978 | Crimmins | |
| 4,602,834 | A * | 7/1986 | Hahn et al. | 439/514 |
| 4,607,899 | A * | 8/1986 | Romine et al. | 439/512 |
| 4,659,158 | A * | 4/1987 | Sakamoto et al. | 439/507 |
| 5,000,699 | A * | 3/1991 | Nadin | 439/511 |
| 5,169,337 | A * | 12/1992 | Ortega et al. | 439/510 |
| 5,449,301 | A * | 9/1995 | Hanna et al. | 439/510 |
| 6,341,967 | B1 * | 1/2002 | Nabeshima et al. | 439/130 |
| 6,402,548 | B1 * | 6/2002 | Ruiz et al. | 439/507 |
| 7,153,157 | B2 * | 12/2006 | Robinson et al. | 439/508 |
| 7,351,103 | B1 * | 4/2008 | Peng et al. | 439/595 |
| 7,938,677 | B1 * | 5/2011 | Zhu | 439/510 |
| 2006/0211299 | A1 * | 9/2006 | Takaya et al. | 439/507 |

OTHER PUBLICATIONS

International Search Report for PCT/US2010/035601.

* cited by examiner

*Primary Examiner* — Gary F. Paumen
(74) *Attorney, Agent, or Firm* — Timothy M. Morella

(57) ABSTRACT

A loop connector comprises first and second connectors. The first connector has a first housing and a pair of first terminals, is configured to be surface-mounted on a top surface of a board, and has a fitting face thereof extending in a direction intersecting the top surface of the board. The second connector has a second housing and a second terminal configured to contact one of the first terminals, is configured to engage the first connector, and has a fitting face thereof extending in a direction intersecting an extending direction of the second terminal. The second housing is provided with a second terminal accommodation-concave portion. The second terminal is provided with a pair of terminal bodies and a connecting portion to connect thereto, the terminal bodies being perpendicular to the connecting portion when the second terminal is press-fit into the second terminal accommodation-concave portion.

11 Claims, 13 Drawing Sheets

LOOP CONNECTOR AND CLOSED-CIRCUIT FORMING CONNECTOR

REFERENCE TO RELATED APPLICATIONS

The Present Disclosure claims priority to prior-filed Japanese Patent Application No. 2009-122039, entitled "Loop Connector And Closed-Circuit Forming Connector," and filed 20 May 2009, the contents of which is fully incorporated in its entirety herein.

BACKGROUND OF THE PRESENT DISCLOSURE

The Present Disclosure relates to a loop connector and a closed-circuit forming connector.

Loop connectors have been used for electrically connecting a pair of circuit boards, such as that disclosed in Japanese Utility Model Application No. 54-93795. Such a loop connector has a pair of circuit boards which are arranged in parallel.

FIG. 13 illustrates another conventional loop connector. Referring to FIG. 13, the housing of a loop connector 811 is engaged, by fitting, with one end of a first circuit board 891 which is one from a pair of edge cards and with one end of a second circuit board 892 which is the other one from the pair of edge cards. Specifically, a pair of guide grooves 813 is formed on the housing 811, and connecting ends of each of the first circuit board 891 and the second circuit board 892 are inserted into each of the guide grooves 813. Moreover, a tape cable 851 is fitted into the housing 811, and both ends of the tape cable 851 are connected, by welding or the like, to the connecting ends of each of the first circuit board 891 and the second circuit board 892. Furthermore, connection portions that connect both ends of the tape cable 851 to the connecting ends of each of the first circuit board 891 and the second circuit board 892 are protected by a protective cover 814. In this way, each of conductive traces of the first circuit board 891 is electrically connected to each of conductive traces of the second circuit board 892.

However, the conventional loop connector has a large format and a complex structure because it is used for connecting the conductive traces of the first circuit board 891 and the conductive traces of the second circuit board 892, and it is thus practically impossible to be used for connecting two conductive traces of a sheet of circuit board. For example, when a plurality of electronic elements is arranged in two lines on a sheet of circuit board and all the electronic elements need to be serially connected, it is necessary to connect a conductive trace which is connected to the output terminal of the electronic element located at the termination end of one line to a conductive trace which is connected to the input terminal of the electronic element located at the termination end of the other line. In such a case, it is practically impossible to use the conventional loop connector for connecting the two conductive traces.

Moreover, since the tape cable 851 has both ends thereof being configured to be securely connected, by welding or the like, to the connecting ends of each of the first circuit board 891 and the second circuit board 892, the connecting operation is difficult to perform, and also the disconnecting operation is impossible to perform; therefore, it is extremely troublesome to handle the loop connector.

SUMMARY OF THE PRESENT DISCLOSURE

Therefore, it is an object of the Present Disclosure to solve the above-described problems encountered by the conventional loop connector and to provide a loop connector and a closed-circuit forming connector having a configuration where a loop terminal, integrally formed, and includes a pair of terminals and a connecting portion is press-fit into a housing, thereby enabling the positioning of the terminal to be appropriately held and mutual connection of a pair of connectors to be stabilized. As a result, it is possible to realize a low height and miniaturization of a loop connector and a closed-circuit forming connector. Accordingly, the loop connector and the closed-circuit forming connector allow easy production thereof, to have a simple structure and high reliability in operation with a low number of parts and production costs.

Therefore, a loop connector according to the Present Disclosure includes a first connector having a first housing made of an insulating material and a pair of first terminals fitted in the first housing, where the first connector is configured to be surface-mounted on an end of a top surface of a board and has a fitting face thereof extended in a direction intersecting the top surface of the board; and a second connector having a second housing made of an insulating material and a second terminal fitted in the second housing and configured to make contact with the respective terminal in the first terminals so as to electrically connecting the first terminals to each other, where the second connector is configured to be engaged with the first connector and has a fitting face thereof extended in a direction intersecting an extending direction of the second terminal, wherein: the second housing is provided with a second terminal accommodation-concave portion which is configured to accommodate therein the second terminal; and, the second terminal is provided with a pair of terminal bodies and a connecting portion configured to connect respective terminal bodies together, where the terminal bodies are arranged to be perpendicular to the connecting portion when the second terminal is press-fitted into the second terminal accommodation-concave portion.

The loop connector according to the Present Disclosure has a configuration such that the second terminal accommodation-concave portion is provided with a connecting portion accommodation-concave portion that accommodates therein the connecting portion and a pair of body accommodation-concave portions that are arranged to be perpendicular to the connecting portion accommodation-concave portion and accommodate therein the terminal bodies, where each of the body accommodation-concave portions comprise a correcting portion configured to correct the positioning of each of the terminal bodies.

The loop connector according to the Present Disclosure has a configuration such that each of the body accommodation-concave portions comprises a passage allowing portion through which at least a portion of each of the terminal bodies is allowed to pass before the positioning thereof is corrected by the correcting portion, where the correcting portion has a width dimension smaller than that of the passage allowing portion.

The loop connector according to the Present Disclosure has a configuration such that each of the terminal bodies is provided with a fixing portion at a lower end thereof, to which both ends of the connecting portion are connected, the connecting portion accommodation-concave portion being connected to a lower end of each of the body accommodation-concave portions, where the correcting portion is formed on an upper end of each of the body accommodation-concave portions to accommodate an upper end portion of the fixing portion.

Moreover, a closed-circuit forming connector according to the Present Disclosure includes a housing made of an insulating material and a loop terminal fitted in the housing and configured to make contact with counterpart terminals to electrically connecting the counterpart terminals to each other, where the closed-circuit forming connector is configured to be engaged with a counterpart connector and having a fitting face thereof extended in a direction intersecting an extending direction of the loop terminal, wherein: the housing is provided with a terminal accommodation-concave portion which is configured to accommodate therein the loop terminal; and, the loop terminal is provided with a pair of terminal bodies and a connecting portion configured to connect respective terminal bodies together, where the terminal bodies are arranged to be perpendicular to the connecting portion when the loop terminal is press-fitted into the terminal accommodation-concave portion.

The closed-circuit forming connector according to the Present Disclosure has a configuration such that the terminal accommodation-concave portion is provided with a connecting portion accommodation-concave portion that accommodate therein the connecting portion and a pair of body accommodation-concave portions that are arranged to be perpendicular to the connecting portion accommodation-concave portion and accommodate therein the terminal bodies, where each of the body accommodation-concave portion comprise a correcting portion configured to correct the positioning of each of the terminal bodies.

In accordance with the Present Disclosure, the loop connector and the closed-circuit forming connector have a configuration in which the loop terminal which is integrally formed and includes a pair of terminals and the connecting portion is press-fitted into the housing. Due to such a configuration, it is made possible to enable the positioning of the terminal to be appropriately held and mutual connection of a pair of connectors to be stably maintained. As a result, it is made possible to realize a low height and miniaturization of a loop connector and a closed-circuit forming connector. Accordingly, it is possible to provide a loop connector and a closed-circuit forming connector which can be easily produced to have a simple structure with a small number of parts and low production costs.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which:

FIGS. 1A and 1B are perspective views of a first connector according to the Present Disclosure, in which FIG. 1A is a top front perspective view and FIG. 1B is a top rear perspective view, respectively;

FIGS. 2A and 2B are views illustrating the first connector mounted on a board, in which FIG. 2A is a top plan view and FIG. 2B is a side view, respectively;

FIGS. 5A and 5B are perspective views of a second connector according to the Present Disclosure, in which FIG. 5A is a top front perspective view and FIG. 5B is a top rear perspective view, respectively;

FIGS. 6A to 6C are three planar views of the second connector, in which FIG. 6A is a top plan view, FIG. 6B is a rear plan view, and FIG. 6C is a side view, respectively;

FIGS. 9A and 9B are views illustrating a housing of the second connector, in which FIG. 9A is a top rear perspective view, and FIG. 9B is a rear plan view, respectively;

FIGS. 10A and 10B are perspective views of the first and second connectors in their tightly engaged state, in which FIG. 10A is a top rear perspective view of the second connector and FIG. 10B is a top rear perspective view of the first connector, respectively;

DESCRIPTION OF THE PREFERRED EMBODIMENTS

Figure 1A:
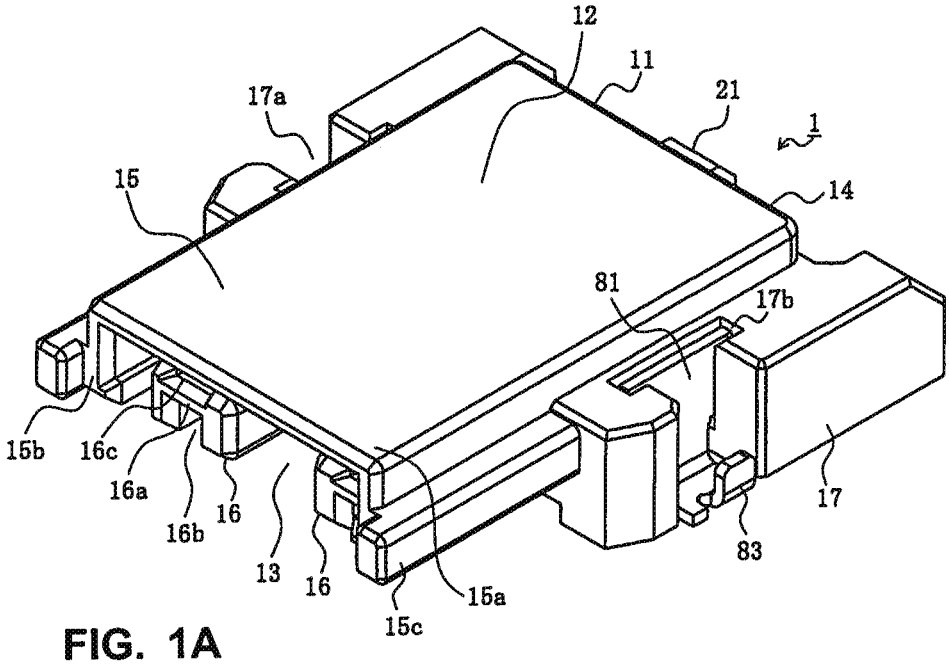

While the Present Disclosure may be susceptible in different forms, there is shown in the Figures, and will be described herein in detail, with the understanding that the disclosure is to be considered an exemplification of the principles of the Present Disclosure, and is not intended to limit the Present Disclosure to that as illustrated.

In the Present Disclosure, directional representations—i.e., up, down, left, right, front, rear and the like, used for explaining the structure and movement of the various elements of the Present Disclosure, are relative. These representations are appropriate when the elements are in the position shown in the Figures. If the description of the position of the elements changes, however, it is assumed that these representations are to be changed accordingly.

The loop connector includes the first connector 1 and the second connector 101, and is configured to electrically connect a pair of conductive traces of the board 91, thereby forming a closed circuit. Although the first connector 1 and the second connector 101 will be described as connectors for connecting together a pair of conductive traces constituting power supply lines of the board 91, the first connector 1 and the second connector 101 may be used as connectors for connecting together a pair of conductive traces constituting signal lines.

Moreover, the board 91 is printed circuit board used for an electronic device or apparatus for example, and may be silicon boards or silicon carbide boards having an electronic device or apparatus arranged directly thereon or may be any type of boards. Furthermore, examples of the electronic device or apparatus include a personal computer, a cellular phone, a digital TV, a car navigation device, and a games machine and the like; however, the type of devices and apparatuses is not intended to be particularly limited.

The first connector 1 includes a first housing 11 as a male board housing which overall has a generally flat rectangular parallelepiped shape and is integrally made of an insulating material such as synthetic resin, first terminals 51 as counterpart terminals which are made from metal and fitted in the first housing 11, and first auxiliary metallic brackets 81 as male board housing-attachment auxiliary metallic brackets which are made from metal and attached to the first housing 11. In the figures, although the number of first terminals 51 is two assuming that the power supply lines include one positive line and one negative line, the number of first terminals 51 may be arbitrarily changed to comply with the number of power supply lines.

As illustrated in the drawing figures, the first housing 11 is provided with a first top plate portion 12 as a top plate portion having a generally rectangular flat-plate shape, a first bottom plate portion 18 as a bottom plate portion which has a flat plate shape opposing the top surface of the board 91 and extends in parallel to the first top plate portion 12, a first body portion 14 as a body portion which has top and bottom surfaces thereof being defined by the first top plate portion 12 and the first bottom plate portion 18 and holds therein the first terminals 51, and a pair of first side wall portions 17, as side wall portions, which is formed so as to extend along edges on both left and right sides of the first body portion 14 and upstand from the first top plate portion 12 and the first bottom plate portion 18. Furthermore, a first fitting face 11*a* as a fitting face is configured to be extended in a direction intersecting (preferably, in a direction substantially perpendicular to) the top surface of the board 91.

The first body portion 14 has formed therein, on a rear end face thereof (the left end face in FIGS. 2 and 3), first terminal accommodation-concave portions 14*b* which are configured to extend in the distal end direction (the rightward direction in FIGS. 2 and 3) from the rear end face and accommodate therein the first terminals 51 and first terminal holding grooves 14*a* which are arranged on the upper ends of the first terminal accommodation-concave portions 14*b* so as to hold therein the first terminals 51. In the example illustrated in the drawing figures, although the numbers of first terminal holding grooves 14*a* and those of first terminal accommodation-concave portions 14*b* are two, respectively, the respective numbers of first terminal holding grooves 14*a* and first terminal accommodation-concave portions 14*b* may be arbitrarily changed to comply with the number of first terminals 51.

Figure 1B:
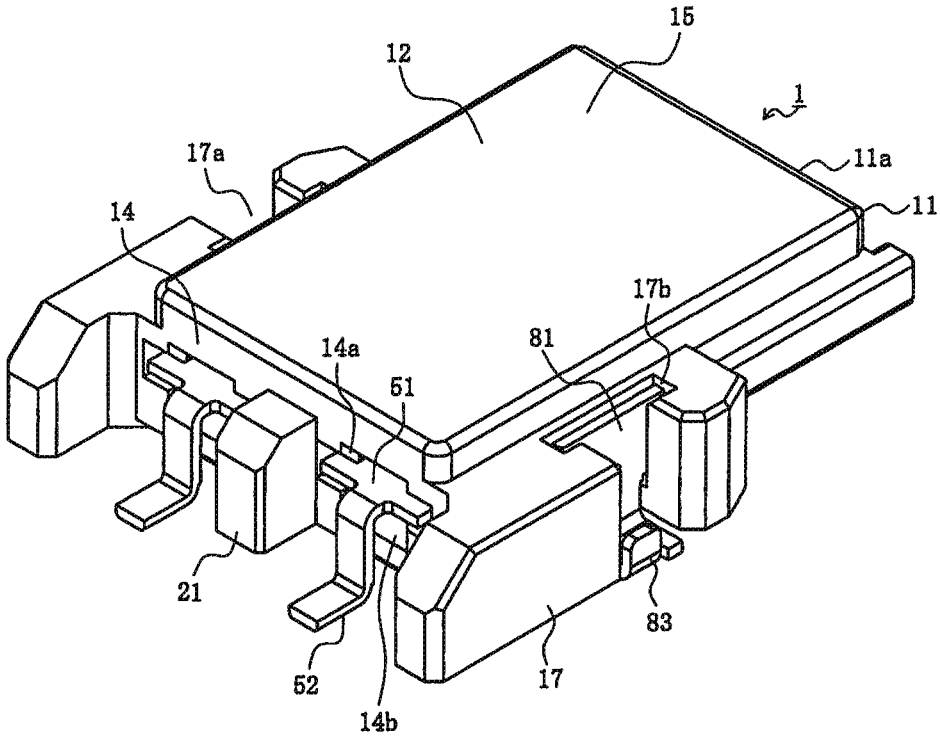
Figure 2A:
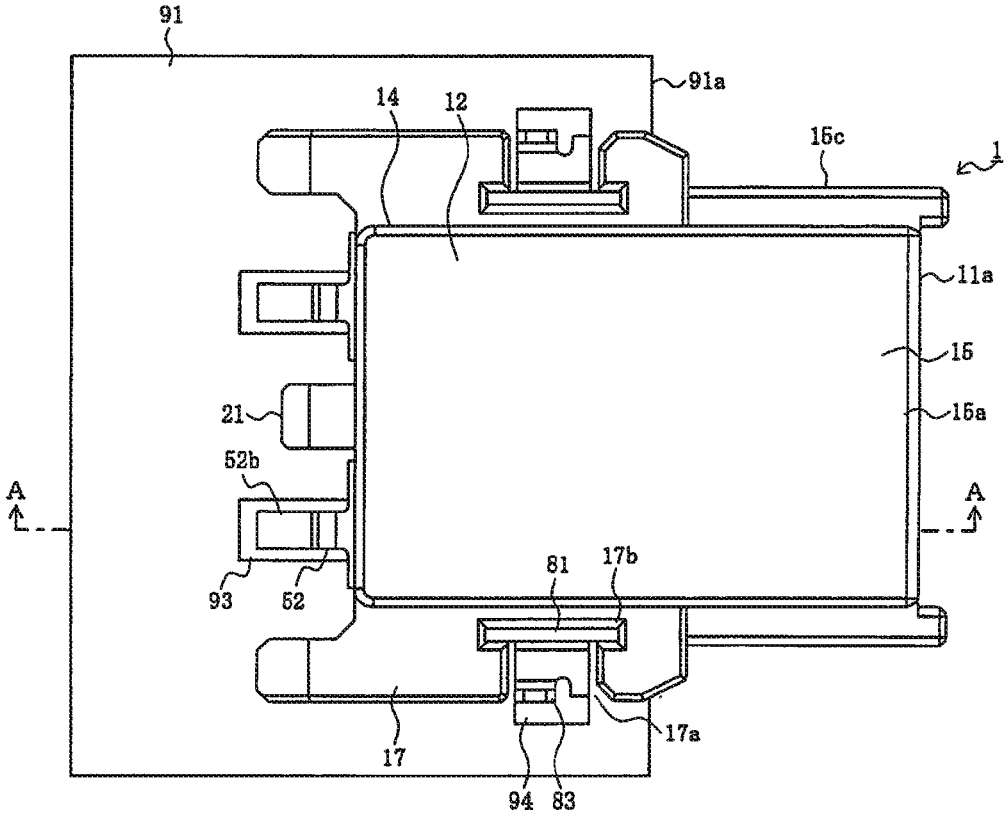
Figure 2B:
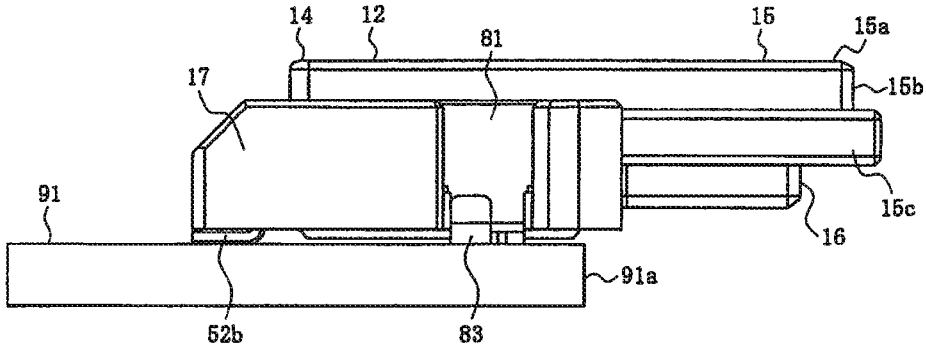

Each of the first side wall portions 17 has formed therein a concave portion 17*a* and a bracket holding groove 17*b* so that both end portions of each of the first auxiliary metallic brackets 81 are accommodated and held in the bracket holding groove 17*b*. Moreover, first connecting portions 83 as connecting portions, which are formed on the lower ends of the first auxiliary metallic brackets 81, are fixedly secured, by soldering or the like, to first connector fixing portions 94 such as solder pads which are formed on the top surface of the board 91. In this way, the first connector 1 can be firmly secured to the board 91. As illustrated in FIGS. 1 and 2, it is preferable that the first auxiliary metallic brackets 81 and the first connecting portions 83 do not protrude rightward or leftward from the side faces of the first side wall portions 17.

A first engagement portion as an engagement portion, designated by reference numeral 15 is configured to extend in the distal end direction from the first body portion 14 so as to be engaged with the second connector 101. The first engagement portion 15 is provided with a first engagement top plate portion 15*a* which is formed to be even with the first top plate portion 12, a pair of first engagement side wall portions 15*b* which extends along the edges of the left and right sides of the first engagement top plate portion 15*a* while vertically extending downward (in a direction toward the board 91) from the first engagement top plate portion 15*a*, and first convex engagement portions 15*c* which have a rod-like shape with a rectangular cross section and are configured to extend along the lower ends of the first engagement side wall portions 15*b*, bulge outward from the left and right end faces of the first engagement side wall portions 15*b*, and slightly protrude in the distal end direction from the front ends of the first engagement side wall portions 15*b*. In other words, the first engagement top plate portion 15*a* can be referred to as a portion of the first top plate portion 12.

A first concave engagement portion, designated by reference numeral 13 is configured to be engaged with the second connector 101 and has three sides thereof being defined by the first engagement top plate portion 15*a* and the first engagement side wall portions 15*b*. In the first concave engagement portion 13, first terminal restricting portions 16 as terminal restricting members are arranged so as to extend in the distal end direction from the first body portion 14. The first terminal restricting portions 16 are generally rod-like members having a base end thereof being connected to the first body portion 14 and a distal end thereof being configured as a free end. In the example illustrated in the drawing figures, although the number of first terminal restricting portions 16 is two, the number of first terminal restricting portions 16 may be arbitrarily changed to comply with the number of first terminals 51.

The distal end portion of each of the first terminal restricting portions 16 has a generally H-shape and includes a beam portion 16*a* which extends in a lateral direction, a lower groove portion 16*b* which has a rectangular cross section with an opened lower surface and is formed on the lower surface side of the beam portion 16*a*, and an upper groove portion 16*c* which has a rectangular cross section with an opened upper surface and is formed on the upper surface side of the beam portion 16*a*. The beam portions 16*a* are connected to tongue-shaped portions 16*d* which extend toward the base ends of the first terminal restricting portions 16.

Figure 4:
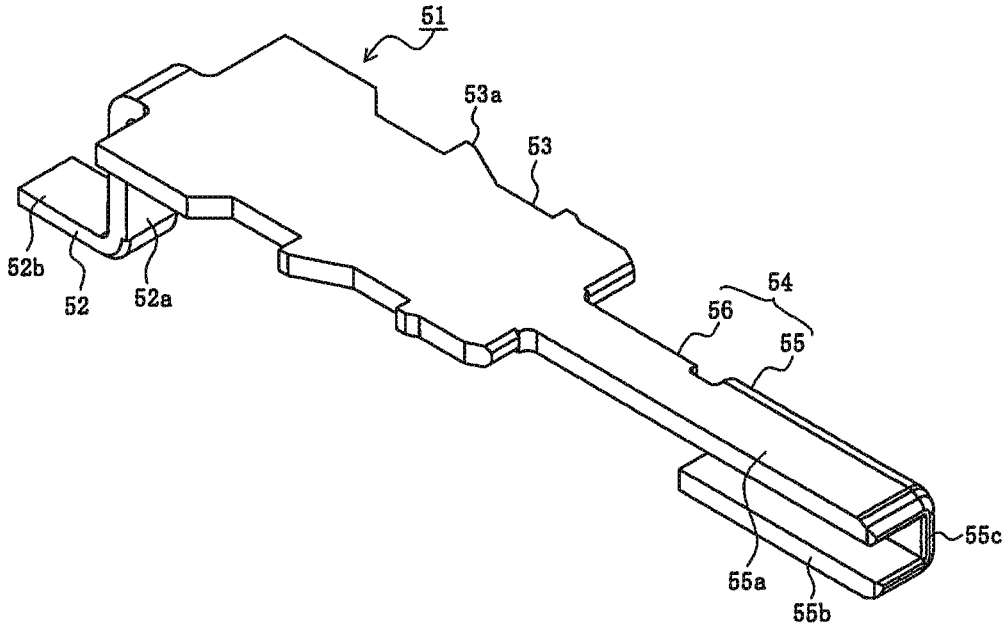
FIG. 4 is a perspective view of the first terminal according to the Present Disclosure.

The first terminals 51 are integrally formed, respectively, by applying processing, e.g., bending or punching, to a metal plate. As illustrated in FIG. 4, each of the first terminals 51 is provided with a first fixing portion 53 as a body portion, a first tail portion 52 as a first surface connecting portion which is connected to the rear end of the first fixing portion 53, and a first contacting arm portion 54 which is connected to the front end of the first fixing portion 53. The first fixing portion 53 is held in a state of being press-fitted into the first terminal holding groove 14*a* of the first body portion 14, and is provided with first locking projections 53*a* which project outward from the lateral sides thereof, the first locking projections 53*a* being squeezed into the wall surfaces of the first terminal holding groove 14*a*, thereby realizing a firm holding state.

The first tail portion 52 has a generally crank-like lateral shape. The first tail portion 52 is provided with a vertical leg portion 52*a* which extends in the vertical direction and has an upper end thereof bent at about right angles to be connected to the rear end of the first fixing portion 53 and a connecting plate portion 52*b* which is bent at about right angles to be connected to the lower end of the vertical leg portion 52*a*. The connecting plate portion 52*b* is electrically connected and secured, by soldering or the like, to a first connector electrode portion 93, such as a conductive pad, formed on the top surface of the board 91. Hence, the first terminals 51 are connected to non-illustrated conductive traces for power supply of the board 91, formed to be connected to the first connector electrode portions 93. Although the first tail portion 52 is exposed rearward (in the leftward direction in FIGS. 2 and 3) from the rear surface of the first body portion 14, it is preferable that the first tail portion 52 does not protrude rearward beyond the rear end of each of the first side wall portions 17 and does not protrude upward from the upper end of each of the first side wall portions 17.

The first contacting arm portion 54 is provided with a first contacting distal end portion 55 and a first base end portion 56. The first contacting distal end portion 55 is a portion which comes into contact with either one of later-described second terminal bodies 151 of the second connector 101. The first contacting distal end portion 55 is a channel-shaped portion having a substantially square cross-section opened at one side and extending in the distal end direction from the distal end of the first base end portion 56. The first contacting distal end portion 55 includes a top plate portion 55*a* connected to the distal end of the first base end portion 56, a bottom plate portion 55*b* extending in parallel to the top plate portion 55*a*, and a side plate portion 55*c* which connects either of the left and right lateral edges of the top plate portion 55*a* and the bottom plate portion 55*b* and extends in the same direction as the extending direction of the top plate portion 55*a* and the bottom plate portion 55*b*.

The first base end portion 56 is an elongated plate-like member narrower than the width of the first fixing portion 53 and has a base end thereof being connected to the distal end of the first fixing portion 53 while having a distal end thereof being connected to the base end of the first contacting distal end portion 55. Moreover, since the first contacting distal end portion 55 has a channel shape having a cross-section in the form of substantially squared U-shape, the first contacting distal end portion 55 has a large secondary section modulus in the vertical direction and has a high rigidity in the vertical direction. Furthermore, since the first fixing portion 53 has a larger width than the first base end portion 56 and has left and right sides thereof being held by the first terminal holding groove 14*a*, the first fixing portion 53 has a high vertical rigidity.

Figure 3:
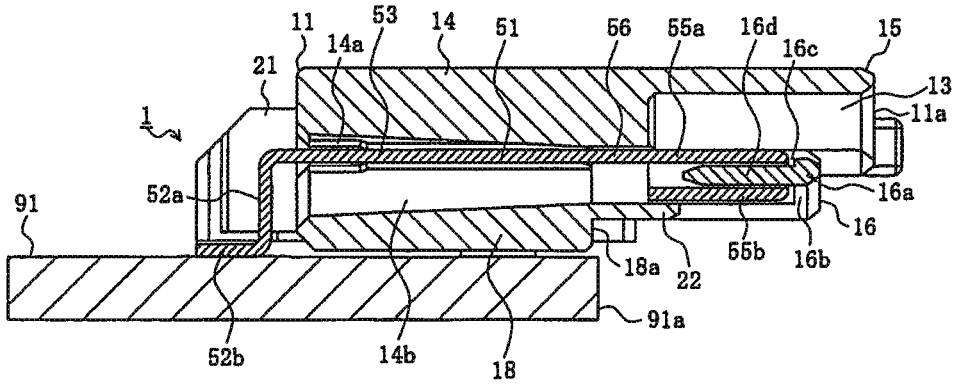
FIG. 3 is a side sectional view of the first connector mounted on the board, taken along the arrows A-A in FIG. 2A.

As illustrated in FIG. 3, when the first terminals 51 are fitted into the first housing 11, the tongue-shaped portions 16*d* of the first terminal restricting portions 16 are inserted from the side of the distal ends of the first contacting distal end portions 55 into portions disposed between the top plate portions 55*a* and the bottom plate portions 55*b* of the first contacting distal end portions 55. Due to such a configuration, the vertical displacement of the first contacting distal end portion 55 is restricted, so that the first contacting distal end portion 55 becomes almost impossible to be displaced in the vertical direction.

The first housing 11 has formed therein a rearwardly projecting wall portion 21 functioning as an insulating distance-procuring portion which is a projecting wall portion configured to rearwardly project from the rear surface of the first body portion 14. The rearwardly projecting wall portion 21 is formed to be positioned between two of the first terminals 51 which are exposed rearward from the rear surface of the first body portion 14. Therefore, it is possible to procure a sufficient insulating distance, namely to procure a sufficiently long insulating distance at least between portions (including a portion of the rear end of the first fixing portion 53 and the first tail portion 52) of two neighboring ones of the first terminals 51 exposed from the rear surface of the first body portion 14. Here, it is preferable that the rearwardly projecting wall portion 21 is at least formed so as to protrude further rearward and upward from the vertical leg portion 52*a* of the first tail portion 52.

The first connector 1 is mounted on the end of the board 91 as illustrated in FIGS. 2 and 3. Although only portions disposed in the vicinity of the end of the board 91 are illustrated in FIGS. 2 and 3 for convenience's sake, actually, the board 91 is in rectangular shape, for example, and is larger than the illustration, and the first connector 1 is mounted on one end of its both longitudinal ends. Specifically, as illustrated in FIG. 3, the first connector 1 is mounted at such a position that the first fitting face 11*a* protrudes outward from an end face 91*a* of the board 91 and that a front end face 18*a* of the first bottom plate portion 18 of the first housing 11 becomes substantially even with the end face 91*a* which is one of both longitudinal ends of the board 91. It should be noted that the front end face 18*a* of the first bottom plate portion 18 is not necessary perfectly even with the end face 91*a* of the board 91; however, it is preferable that the distance between the front end face 18*a* of the first bottom plate portion 18 and the end face 91*a* of the board 91 is short, as illustrated in FIG. 3.

The front end face 18*a* of the first bottom plate portion 18 is provided with a first projecting plate portion 22 which is connected thereto as a projecting plate portion which is formed to extend frontward. The first projecting plate portion 22 is formed to extend in the distal end direction from the upper end of the front end face 18*a* so as to cover an under part of substantially the entire of the first base end portion 56 of the first terminal 51 fitted into the first housing 11 and included in a region located at a front side more than the front end face 18*a*, while also covering an under part of a portion of the first contacting distal end portion 55 located adjacent to the rear end of said end portion 55. The front end of the first projecting plate portion 22 is connected to the base end of the first terminal restricting portion 16.

When a conductive member such as a conductive casing, a conductive plate for electromagnetic shielding, a metal plate for fixation, radiation, or reinforcement, another printed circuit board, another wiring component, or a fixing bracket is arranged on the rear side of the board 91, the first projecting plate portion 22 functions as an insulating distance-procuring portion. Since the conductive member functions as a ground at zero electric potential, a potential difference may appear between the first terminal 51 and the conductive member. If the first projecting plate portion 22 is omitted, the insulating distance between a portion of the conductive member arranged on the rear side of the board 91 and located closer to the front side than the end face 91*a* and the first base end portion 56 and the first contacting distal end portion 55 will be shortened. However, since the first projecting plate portion 22 covers the under part of substantially the entire portions of the first base end portion 56 and the portion thereof located closer to the rear end of the first contacting distal end portion 55, both the spatial distance (clearance) and the creepage distance between the conductive member and the first base end portion 56 and the first contacting distal end portion 55 can be sufficiently lengthened and thus, a sufficient insulating distance can be procured. Although the first projecting plate portion 22 does not appear at an under part of the most portion of the first contacting distal end portions 55 which is located close to the distal end of the same end portion 55, when the first connector 1 and the second connector 101 are engaged together by fitting, the most part in the vicinity of the distal end of the first contacting distal end portion 55 are inserted in a later-described second housing 111 of the second connector 101. Therefore, it is possible to procure a sufficient insulating distance between the conductive member and the first terminal 51 even when the first contacting distal end portion 55 does not appear.

Figure 8:
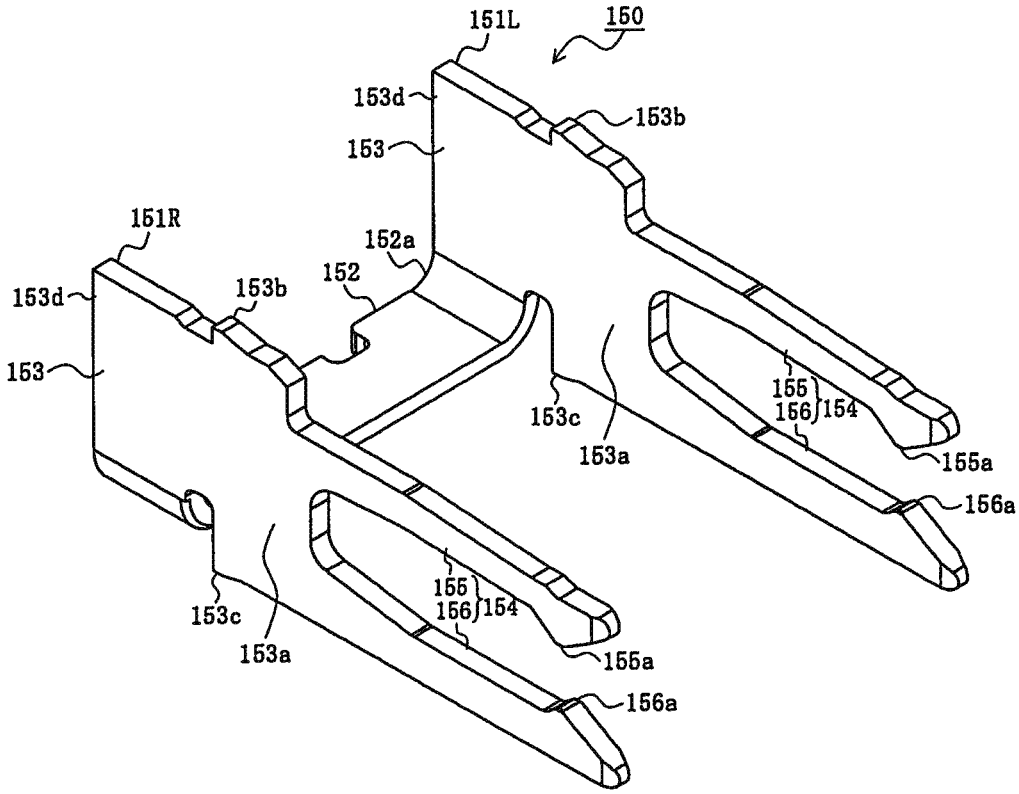
FIG. 8 is a perspective view of the second terminal according to the Present Disclosure.

The second connector 101 includes a second housing 111 as a housing which has a generally rectangular overall shape and is integrally formed of an insulating material such as synthetic resin, and second terminals 150 as loop terminals which are made of metallic material and fitted in the second housing 111. The second terminals 150 are each integrally formed by applying processing, e.g., punching or bending, to a metal plate. As illustrated in FIG. 8, each of the second terminals 150 is provided with a second left terminal body 151L used as a terminal body located on the left side, a second right terminal body 151R used as a terminal body located on the right side, and a connecting portion 152 that connects the second left terminal body 151L and the second right terminal body 151R.

Since the second left terminal body 151L and the second right terminal body 151R have identical shapes, they will be collectively referred to as second terminal bodies 151 used as terminal bodies. Each of the second terminal bodies 151 generally has a bifurcated fork-like shape or a tuning fork-like shape from a side view thereof, and is provided with a second fixing portion 153 used as a fixing portion and a second contacting arm portion 154 which extends forward from the second fixing portion 153. The second contacting arm portion 154 is provided with a second upper contacting arm portion 155 which extends forward from the upper end of the second fixing portion 153 and a second lower contacting arm portion 156 which extends forward from the lower end of the second fixing portion 153. Moreover, both ends of the connecting portion 152 are connected to the lower end of the second fixing portion 153. Therefore, the second terminals 150 have a rear form which is generally U-shaped, in which the second terminal bodies 151 protrude upward from both ends of the connecting portion 152.

Figure 6A:
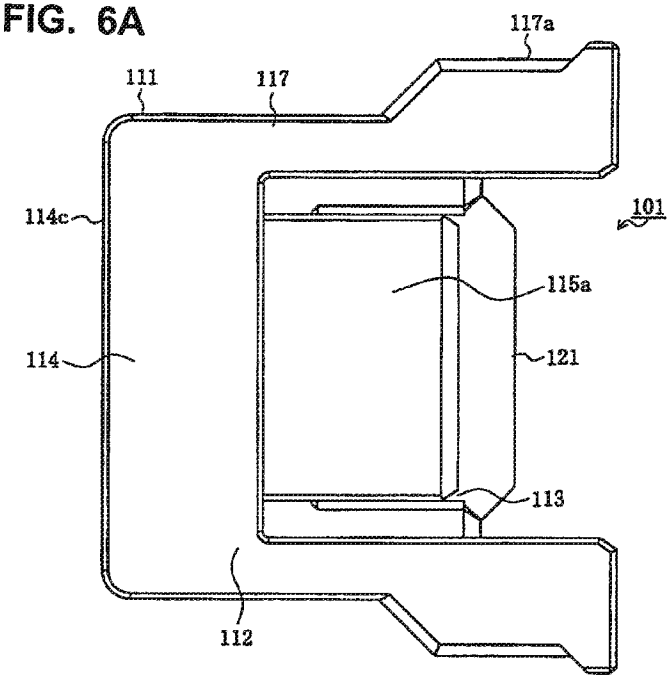

As illustrated in the drawing figures, the second housing 111 is provided with a second bottom plate portion 118 as a bottom plate portion which has a generally rectangular flat-plate shape and is extend in the fitting direction (the horizontal direction in FIGS. 6A and 6C), a second body portion 114 as a body portion which is formed so as to extend along an edge on the rear side (the left end in FIGS. 6A and 6C) of the second bottom plate portion 118 and upstand from the second bottom plate portion 118, thereby holding therein the second terminals 150, and a pair of second side wall portions 117, as side wall portions, which is formed so as to extend along edges on both left and right sides of the second bottom plate portion 118 and upstand from the second bottom plate portion 118. Moreover, a second fitting face 111*a* as a fitting face is configured to extend in a direction intersecting (preferably, in a direction substantially perpendicular to) the fitting direction. The rear ends of the second side wall portions 117 are connected to both left and right ends of the second body portion 114, the upper surface portions of the second side wall portions 117 and the upper surface portion of the second body portion 114 are formed to be continuous and even with each other, thus constituting a second top plate portion 112 having a substantially squared U-shape. Moreover, a central concave portion designated by reference numeral 113 has a lower portion thereof being defined by the second bottom plate portion 118 and three sides thereof being defined by the second side wall portions 117 and the second body portion 114.

The second body portion 114 includes a second terminal accommodation-concave portion 114*a* used as a terminal accommodation-concave portion in which the second terminal 150 is press-fitted to be accommodated therein. Moreover, the second terminal accommodation-concave portion 114*a* is provided with a pair of body accommodation-concave portions 114*d* which are arranged to extend in the distal end direction (the rightward direction in FIGS. 6A and 6C and FIG. 7) from a rear end face 114*c* to accommodate therein one of the respective second terminal bodies 151 and a connecting portion accommodation-concave portion 114*b* which is configured to accommodate therein the connecting portion 152.

A locking arm portion 117*a* is defined at the vicinity of the front end (the right end in FIGS. 6A and 6C) of each of the second side wall portions 117, and convex engagement portions 117*b* are formed on the inner side faces of the locking arm portion 117*a* so as to engage the concave portions 17*a* which are formed on the first side wall portions 17 of the first connector 1.

A second engagement portion as an engagement portion, designated by reference numeral 115 is arranged within the central concave portion 113 so as to be engaged with the first connector 1. The second engagement portion 115 is provided with a second engagement top plate portion 115*a* which is formed to be in parallel to the second top plate portion 112, and a second engagement support wall portion 115*b* which extends in the front-to-rear direction and supports the second engagement top plate portions 115*a*. The second engagement support wall portion 115*b* is formed so as to upstand from the second bottom plate portion 118 at the central portion in the width direction of the second bottom plate portion 118 and has its upper end to which the second engagement top plate portion 115*a* is connected.

The second engagement top plate portion 115*a* is arranged at a lower position than the second top plate portion 112 which surrounds the three sides thereof. When the first connector 1 and the second connector 101 are engaged together by fitting, the first engagement top plate portion 15*a* of the first engagement portion 15 is positioned so as to overlap the upper surface of the second engagement top plate portion 115*a* so that the upper surface of the first engagement top plate portion 15*a* becomes substantially even with the upper surface of the second top plate portion 112. The upper surface of the second engagement top plate portion 115*a* is smooth and flat and may function as a suctioned surface which is absorbed and sucked by a suction tool arranged at the distal end of a tool such as a robot hand. The absorption and suction by the suction tool is generally impossible when an uneven structure such as a scratch exists on the suction surface. However, since the upper surface of the second engagement top plate portion 115*a* has its three sides thereof being surrounded by the second top plate portion 112 having a large height, the upper surface is hardly damaged by coming into contact with other members during operations such as assembly steps. Therefore, the upper surface of the second engagement top plate portion 115*a* is free of uneven structures and is thus able to reliably function as a suctioned surface.

Moreover, spaces between the second engagement top plate portion 115*a* and the second bottom plate portion 118 on both left and right sides of the second engagement support wall portion 115*b* are configured as second concave engagement portions 113*a* as concave portions which are engaged with the first connector 1. The first terminal restricting portion 16 and the first contacting distal end portion 55 of the first terminal 51 are inserted into the second concave engagement portions 113*a*. Furthermore, slit-like openings which are formed between both left and right edges of the second engagement top plate portion 115*a* and the second side wall portions 117 on the left and right sides so as to extend in the front-to-rear direction are configured as second lateral engagement concave portions 113*b* which are in communication with the second concave engagement portions 113*a*. The first engagement side wall portions 15*b* of the first engagement portion 15 are inserted into the second lateral engagement concave portions 113*b*. In addition, on the inner left and right side faces of the second side wall portions 117, second engagement groove portions 117*c* are formed, which are trenches having a rectangular cross section; opened toward the second concave engagement portions 113*a*, and extending in the front-to-rear direction. The first convex engagement portions 15*c* of the first engagement portion 15 are inserted into the second engagement groove portions 117*c*.

Figure 5A:
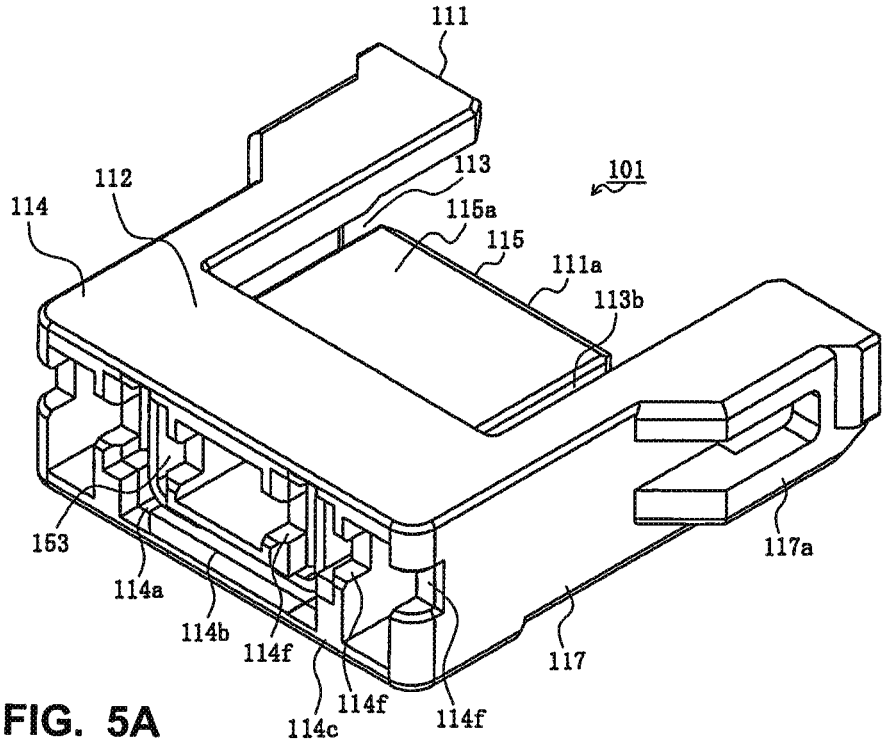
Figure 5B:
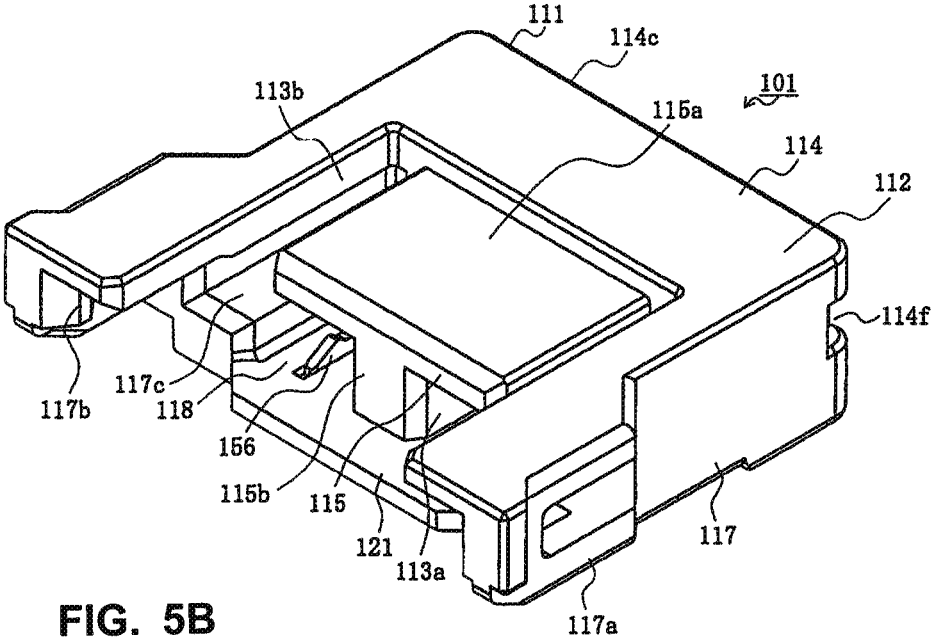

The front end of the second bottom plate portion 118 is connected to a second projecting plate portion 121 as a projecting plate portion which is configured to extend forward. The second projecting plate portion 121 is formed to extend in the distal end direction from the front end of the second bottom plate portion 118 so as to protrude forward from the front end of the second engagement portion 115 as illustrated in FIG. 5B.

An upper contacting portion 155*a* configured to protrude downward is formed at the free end, namely in the vicinity of the distal end of the second upper contacting arm portion 155 of the second terminal body 151, and a lower contacting portion 156*a* configured to protrude upward is formed at the free end, namely in the vicinity of the distal end of the second lower contacting arm portion 156. The upper contacting portion 155*a* and the lower contacting portion 156*a* are portions which function as second contacting distal end portions of the second terminal bodies 151 and come into electrical contact with the first contacting distal end portions 55 of the first terminals 51. Since at least the second upper contacting arm portion 155 of the second contacting arm portion 154 has some degree of flexibility and is thus able to elastically deform in the vertical direction, at least the upper contacting portion 155*a* is able to elastically deform in the vertical direction to some extent.

The second fixing portion 153 is provided with a contacting arm-holding portion 153*a* which is connected to the base end of the second upper contacting arm portion 155 and the base end of the second lower contacting arm portion 156, a second upward locking projection 153*b* which is configured to project upwards from the upper end of the contacting arm-holding portion 153*a*, and a second downward locking projection 153*c* which is configured to project downward from the lower end of the contacting arm-holding portion 153*a*. When the second terminal bodies 151 are press-fitted into the body accommodation-concave portion 114*d*, the second upward locking projection 153*b* is squeezed into the lower surface of the second top plate portion 112 so as to be locked there, and the second downward locking projection 153*c* is squeezed into the upper surface of the second bottom plate portion 118 so as to be locked there. The upper end and the lower end of the contacting arm-holding portion 153*a* are respectively press-fitted into the lower surface of the second top plate portion 112 and the upper surface of the second bottom plate portion 118. That is to say, the second terminal bodies 151 are securely held in the body accommodation-concave portion 114*d* when the second upward locking projection 153*b* is squeezed into the lower surface of the second top plate portion 112, the second downward locking projection 153*c* is squeezed into the upper surface of the second bottom plate portion 118, and the second fixing portion 153 is pinched from the upper and lower sides by the second top plate portion 112 and the second bottom plate portion 118.

As will be understood from the shape illustrated in FIG. 8, the second terminal 150 is obtained by applying a bending process to a plate-like member, which is integrally formed by applying a punching process to a metal plate, and bending the connecting portion 152*a* that connects together both ends of the connecting portion 152 and the lower end of left and right the second fixing portion 153 so as to have a shape such that the second terminal bodies 151 including the second fixing portion 153 are perpendicular to the connecting portion 152. Moreover, the second terminal bodies 151 on the left and right sides are parallel to each other.

Due to such a configuration, in a state where the first connector 1 and the second connector 101 are engaged, by fitting, together, the second upper contacting arm portions 155 and the second lower contacting arm portions 156 on the left and right sides assume a configuration where they are perpendicular to the top plate portion 55*a* and the bottom plate portion 55*b* of the first contacting distal end portion 55 of the first terminal 51. Therefore, the upper contacting portion 155*a* and the lower contacting portion 156*a* can make firm contact with the top plate portion 55*a* and the bottom plate portion 55*b*.

However, due to reasons such as spring-back, even when a bending process is performed by a pressing machine, it is generally difficult to bend a metal-made flat plate to a perfect 90 degree angle. It goes without saying that when such a small member as the second terminal 150 is formed, it may be difficult, but not impossible, to achieve a perfect 90 degree angle of the second fixing portion 153 with respect to the connecting portion 152 even when the bending process is applied thereto; such an operation may take considerable labor and time, and consequently, the production cost of the second terminal 150 will increase.

Figure 9A:
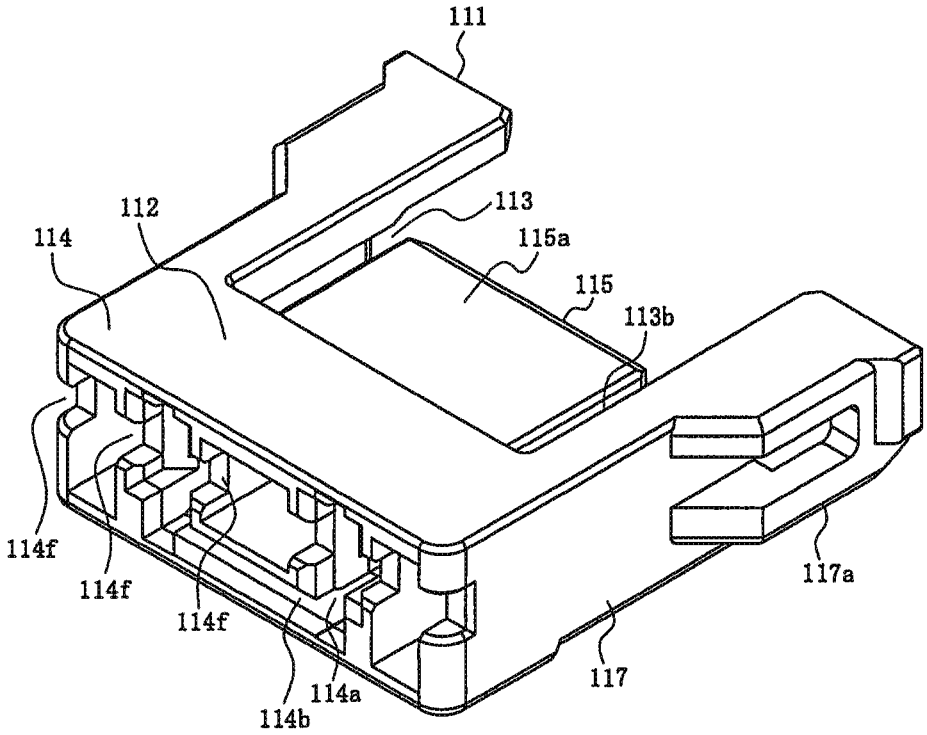
Figure 9B:
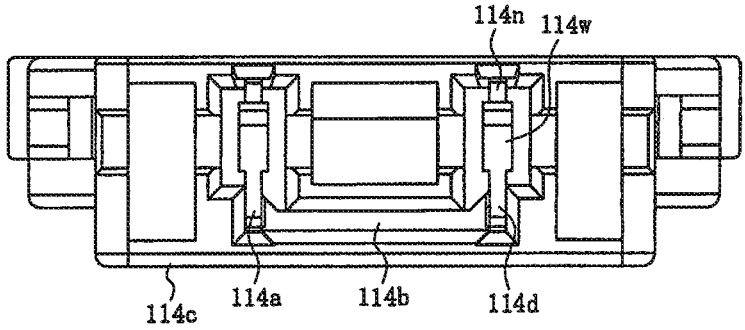

As illustrated in FIGS. 9A and 9B, the connecting portion accommodation-concave portion 114*b* is opened into a slit form so as to extend in the left-right direction on the rear end face 114*c* of the second body portion 114, and the left and right body accommodation-concave portions 114*d* are opened into a slit form so as to extend in the downward direction on the rear end face 114*c* with lower ends thereof being connected to both ends of the connecting portion accommodation-concave portion 114*b*. That is, the opening of the second terminal accommodation-concave portion 114*a* has a generally U-shaped form. Moreover, each of the body accommodation-concave portions 114*d* is provided with a large-width portion 114*w* used as a passage allowing portion which has a relatively large width dimension and a small-width portion 114*n* as a correcting portion which has a relatively small width dimension and is connected to the upper end of the large-width portion 114*w*. The small-width portion 114*n* has substantially the same thickness dimension as the upper end portion 153*d* of the second fixing portion 153 in the second terminal body 151 and is configured to not permit a horizontal displacement of the upper end portion 153*d*. That is, in a state where the second fixing portion 153 is press-fitted into the body accommodation-concave portion 114*d*, the gap between the side face of the upper end portion 153*d* and the inner side face of the small-width portion 114*n* is zero or extremely small. Moreover, the second left and right terminal accommodation-concave portions 114*a* are formed such that the central lines of the openings thereof are very close and parallel to each other, and the connecting portion accommodation-concave portion 114*b* and the left and right body accommodation-concave portions 114*d* are formed such that the central line of the opening of the connecting portion accommodation-concave portion 114*b* and the central line of the opening of the body accommodation-concave portion 114*d* are at a 90 degree angle.

Due to such a configuration, when the second terminal 150 is inserted from the rear of the second body portion 114 to be press-fitted into the second terminal accommodation-concave portion 114*a* opened to the rear end face 114*c*, the upper end portions 153*d* of the second fixing portions 153 in the second left and right terminal bodies 151 are restricted by the small-width portions 114*n* of the left and right body accommodation-concave portions 114*d*. Therefore, the angle of the second fixing portion 153 with respect to the connecting portion 152 becomes a perfect 90 degree angle, and the second left and right terminal bodies 151 are perfectly parallel to each other. Accordingly, even when a perfect 90 degree angle of the second fixing portion 153 with respect to the connecting portion 152 is not achieved by bending processing, by inserting the second terminal 150 press-fitted into the second terminal accommodation-concave portion 114*a*, it is possible to correct the positioning of the second terminal bodies 151 so that the second terminal 150 has a correct shape such that the angle of the second terminal bodies 151 with respect to the connecting portion 152 is a perfect 90 degree angle and that the second left and right terminal bodies 151 are arranged closely and parallel to each other.

Since the large-width portion 114*w* is connected to the lower end of the small-width portion 114*n*, in an initial stage of the operation for inserting the second terminal 150 into the second terminal accommodation-concave portion 114*a*, at least a portion of the second terminal body 151, for example, the second upper contacting arm portion 155, the second lower contacting arm portion 156, and the like located below the upper end portion 153*d* are able to pass through the large-width portion 114*w* having a large width dimension but not able to pass through the small-width portion 114*n* having a small width dimension. Therefore, since the second upper contacting arm portion 155, the second lower contacting arm portion 156, and the like do not make contact with the inner side faces of the large-width portion 114*w*, it is possible to smoothly insert the second terminal 150 with a small force, and thus, the workability is improved. Moreover, even when the angle of the second terminal body 151 with respect to the connecting portion 152 is not a perfect 90 degree angle and the second upper contacting arm portion 155, the second lower contacting arm portion 156, and the like are inclined with respect to the perpendicular line of the connecting portion 152, namely, even when the second upper contacting arm portion 155, the second lower contacting arm portion 156, and the like are displaced in the transverse direction, they can pass through the large-width portion 114*w*.

Figure 6C:
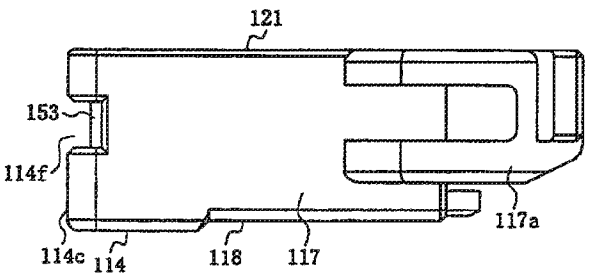
Figure 6B:
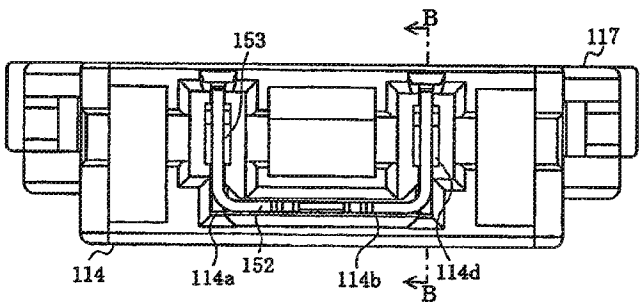
Figure 7:
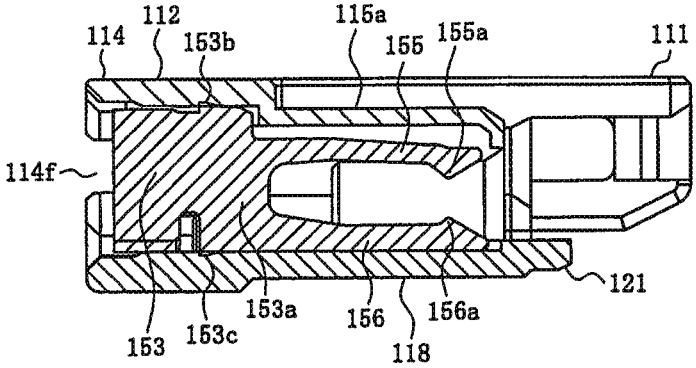
FIG. 7 is a side sectional view of the second connector mounted on the board, taken along the arrows B-B in FIG. 6B.

As illustrated in FIGS. 5A, 6C, 7, and 9A, on the rear end face 114*c* of the second body portion 114, a transverse recess portion 114*f* having a groove shape is formed so as to extend in the transverse direction. The transverse recess portion 114*f* is a concave portion which is configured to receive therein a distal end of a non-illustrated plate-like or rod-like tool used for urging the second terminal 150 to be press-fitted into the second terminal accommodation-concave portion 114*a*. Therefore, as illustrated in FIG. 6C, the transverse recess portion 114*f* is formed such that a bottom face thereof is positioned further forward than the rear end of the second fixing portion 153 of the second terminal 150 that has been fitted. When the second terminal 150 is press-fitted into the second terminal accommodation-concave portion 114*a*, the operator grasps, for example, by hand a plate-like tool so that the front end of the tool extends in the transverse direction, and presses the front end against portions of the second left and right terminal bodies 151 corresponding to the rear end of the second fixing portion 153, thereby applying a forward force. In this way, the operator is able to cause the pair of second left and right terminal bodies 151 to be press-fitted into the left and right body accommodation-concave portions 114*d* by a single operation, and thus, the workability is improved.

Figure 10A:
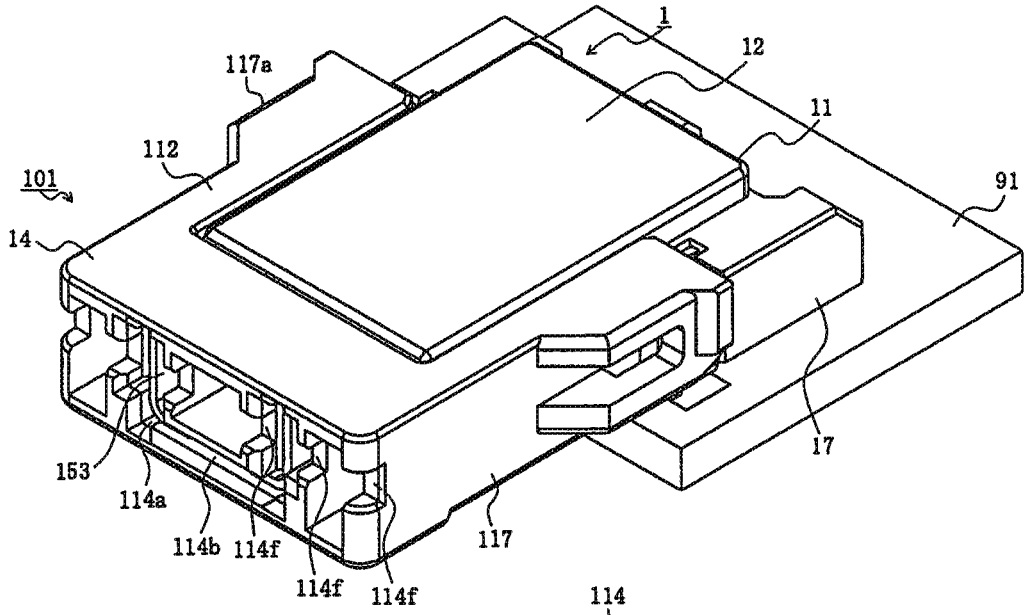
Figure 10B:
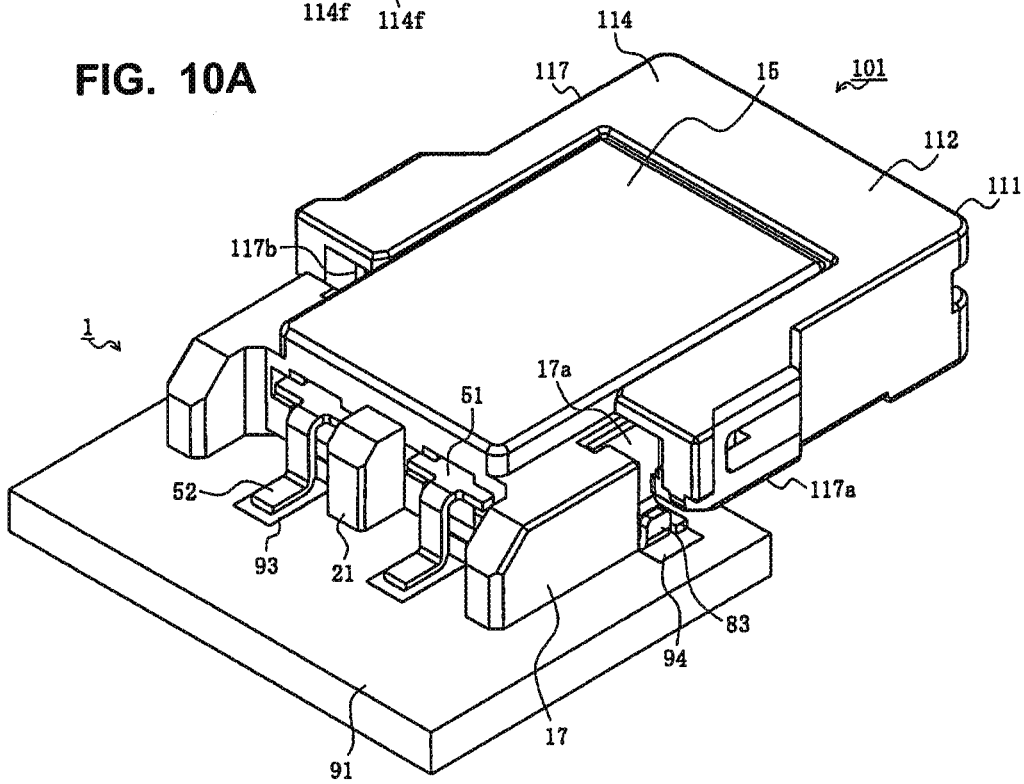
Figure 11:
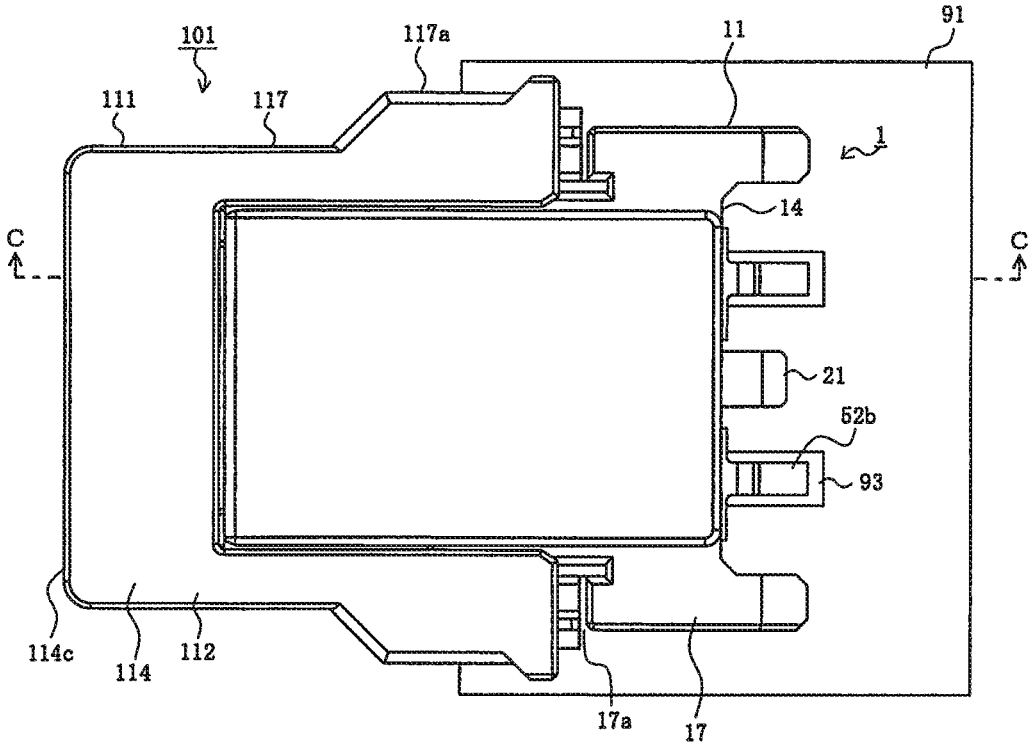
FIG. 11 is a top plan view of the first and second connectors in their tightly engaged state.
Figure 12:
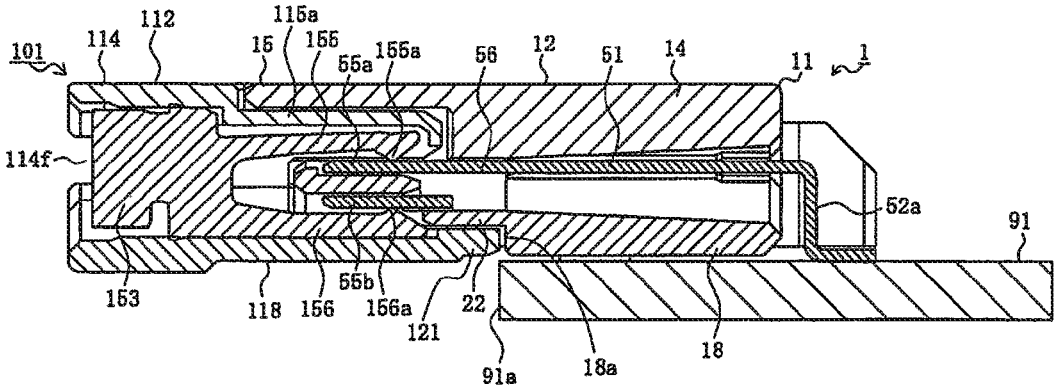
FIG. 12 is a side sectional view of the first and second connectors in their tightly engaged state, taken along the arrows C-C in FIG. 11.
Figure 13:
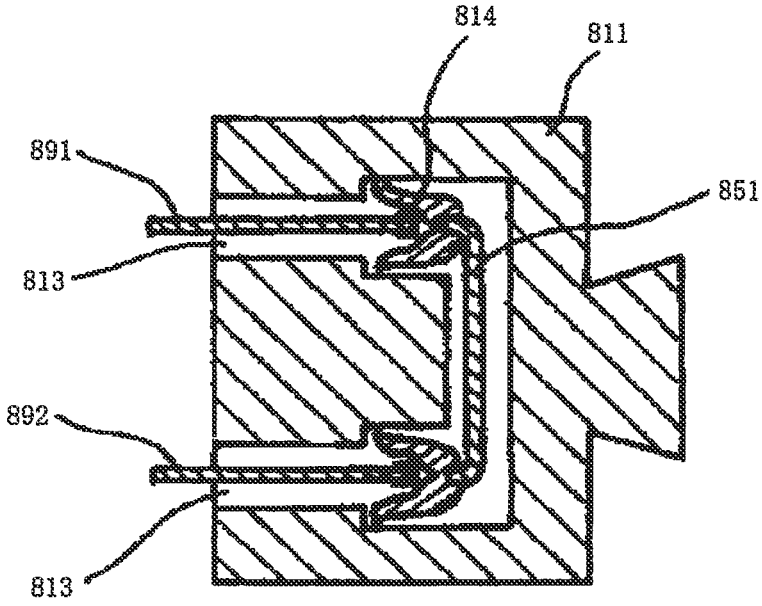
Prior art FIG. 13
FIG. 13 is a side sectional view of a loop connector according to the prior art.

A description of an operation of fitting the first connector 1 and the second connector 101 having the above-described structures to be engaged together is now provided. FIGS. 10A and 10B are perspective views of the first and second connectors in their tightly engaged state of the Present Disclosure; FIG. 11 is a top plan view of the first and second connectors in their tightly engaged state of the Present Disclosure; and FIG. 12 is a side sectional view of the first and second connectors in their tightly engaged state of the Present Disclosure, taken along the arrows C-C in FIG. 11. In FIG. 10, FIG. 10A is a top rear perspective view of the second connector and FIG. 10B is a top rear perspective view of the first connector, respectively.

The first connector 1 is surface-mounted on the board 91 in a state where the connecting plate portion 52*b* of the first tail portions 52 are connected, by soldering or the like, to the first connector electrode portions 93 formed on the top surface of the board 91, and that the first connecting portions 83 of the first auxiliary metallic brackets 81 are connected, by soldering or the like, to the first connector fixing portions 94 formed on the top surface of the board 91.

Then, an operator moves the first connector 1 and/or the second connector 101 toward either one of the connectors in a state where the first fitting face 11*a* of the first connector 1 opposes the second fitting face 111*a* of the second connector 101 so that the first terminal restricting portions 16 and the first contacting distal end portions 55 of the first terminals 51 of the first connector 1 are inserted into the second concave engagement portions 113*a* of the second connector 101. Moreover, the first engagement side wall portions 15*b* of the first engagement portion 15 of the first connector 1 are inserted into the second lateral engagement concave portions 113*b* of the second connector 101. Furthermore, the first convex engagement portions 15*c* of the first engagement portion 15 of the first connector 1 are inserted into the second engagement groove portions 117*c* of the second connector 101. In this way, the first connector 1 and the second connector 101 are engaged together as illustrated in FIGS. 10 to 12.

At this time, as illustrated in FIG. 12, the first contacting distal end portion 55 of the first terminal 51 of the first connector 1 comes to be positioned between the upper contacting portion 155*a* and the lower contacting portion 156*a* of the second left and right terminal bodies 151 of the second connector 101. Moreover, the upper contacting portion 155*a* and the lower contacting portion 156*a* of the second terminal bodies 151 come into contact with the top plate portion 55*a* and the bottom plate portion 55*b* of the first contacting distal end portion 55. In this way, the first terminal 51 and the second left terminal body 151L disposed on the left side are electrically connected to each other, and the first terminal 51 and the second right terminal body 151R disposed on the right side are electrically connected to each other. As a result, a pair of first terminals 51 is electrically connected to each other via the second terminal 150. Therefore, the conductive trace connected to the first connector electrode portion 93 on the board 91 being connected to the first tail portion 52 of one from the pair of the first terminals 51 is electrically connected to the conductive trace connected to the first connector electrode portion 93 on the board 91 being connected to the first tail portion 52 from the other one of the pair of first terminals 51, thereby forming a closed circuit.

When the first contacting distal end portions 55 of the first terminals 51 come to be positioned between the upper contacting portions 155*a* and the lower contacting portions 156*a* of the second terminal bodies 151, the distance between the upper contacting portions 155*a* and the lower contacting portions 156*a* is increased. In this case, the second upper contacting arm portions 155 are elastically deformed vertically, so that the upper contacting portions 155*a* are elastically displaced upwardly, thereby increasing the distance between the upper contacting portions 155*a* and the lower contacting portion 156*a*. Therefore, the operator is able to perceive, by a sense of click-feeling, the resistance that the first contacting distal end portions 55 of the first terminals 51 receive when the upper contacting portions 155*a* are elastically displaced upwardly. Accordingly, the operator is able to correctly become aware of and to confirm completion of the operation of electrically connecting the first terminals 51 and the second terminals 150 so that the first connector 1 and the second connector 101 are engaged together. Moreover, since the first contacting distal end portions 55 of the first terminals 51 are elastically grasped from the upper and lower sides by the upper contacting portions 155*a* and the lower contacting portions 156*a* of the second terminal bodies 151, it is possible to certainly maintain stable contact between the first contacting distal end portions 55 and the upper contacting portions 155*a* and the lower contacting portions 156*a*.

When the engagement between the first and second connectors 1, 101 is completed, as illustrated in FIG. 12, the second projecting plate portion 121 of the second housing 111 covers the entire lower surface of the first projecting plate portion 22 of the first housing 11. Therefore, a portion disposed right above the end face 91*a* of the board 91 is covered by the first projecting plate portion 22 and the second projecting plate portion 121 which overlap with each other.

As described above, when a conductive member such as a conductive casing, a conductive plate for electromagnetic shielding, a metal plate for fixation, radiation, or reinforcement, another printed circuit board, another wiring component, or a fixing bracket is arranged on the rear side of the board 91, since the conductive member functions as the ground at zero electric potential, if the first projecting plate portion 22 and the second projecting plate portion 121 do not appear, the insulating distance between the conductive member disposed under the end face 91*a* of the board 91 and the first terminals 51 and/or the second terminals 151 will be shortened. As will be easily understood from FIG. 12, particularly, the insulating distance between the conductive member and the bottom plate portions 55*b* of the first contacting distal end portions 55 of the first terminals 51 and/or the distal ends of the second lower contacting arm portions 156 of the second terminals 151 will also be shortened.

However, the first projecting plate portion 22 and the second projecting plate portion 121 which overlap with each other cover the portion disposed right above the end face 91*a* of the board 91. Therefore, both the spatial distance and the creepage distance between the conductive member and the bottom plate portions 55*b* of the first contacting distal end portions 55 of the first terminals 51 and/or the distal ends of the second lower contacting arm portions 156 of the second terminal bodies 151 can be sufficiently lengthened, and thus, a sufficient insulating distance can be procured.

For example, as will be obvious from the example illustrated in FIG. 12, the above-mentioned creepage distance can be sufficiently long by virtue of the fact that it is approximately identical to the total sum of the distances of paths: including a path extending from the lower end to the upper end of the board 91 along its end face 91*a*; a path extending from the lower end to the upper end of the first bottom plate portion 18 along its front end face 18*a* (or a path extending from the lower end to the upper end of the second projecting plate portion 121 along its front end face); and a path extending from the base end to the distal end of the first projecting plate portion 22 along its lower surface (or a path extending from the distal end to the base end of the second projecting plate portion 121 along its upper surface).

Therefore, it is possible to certainly prevent occurrence of any short-circuit accidents between the conductive member and the first terminals 51 and/or the second terminal bodies 151. In the example illustrated in the drawing figures, only the first contacting distal end portion 55 and the first base end portion 56 of each of the first terminals 51 are positioned right above the end face 91*a* of the board 91. However, the second upper contacting arm portion 155 or the second lower contacting arm portion 156 of each of the second terminal bodies 151 may be positioned right above the end face 91*a* of the board 91. Moreover, either one of the first projecting plate portion 22 or the second projecting plate portion 121 may be omitted as required.

When the engagement between the first connector 1 and the second connector 101 is completed, the first engagement side wall portions 15*b* of the first engagement portion 15 of the first housing 11 come into the second lateral engagement concave portions 113*b* of the second housing 111. Moreover, the first convex engagement portions 15*c* of the first engagement portion 15 of the first housing 11 come into the second engagement groove portions 117*c* of the second housing 111, and the first engagement top plate portion 15*a* of the first engagement portion 15 of the first housing 11 comes into the central concave portion 113 of the second housing 111. Furthermore, the first engagement top plate portion 15*a* overlaps the upper surface of the second engagement top plate portion 115*a* of the second housing 111.

The convex engagement portions 117*b* of the second connector 101 which are formed on the inner side faces of the locking arm portion 117*a* are engaged with the concave portions 17*a* of the first side wall portions 17 of the first connector 1, whereby the first connector 1 and the second connector 101 are locked.

Due to the described configuration, the first housing 11 and the second housing 111 can be firmly engaged together, and accordingly, the engagement between the first connector 1 and the second connector 101 is not released even when the relative positional relationship between the first connector 1 and the second connector 101 changes.

As described above, the loop connector includes the first connector 1 having the first housing 11 made of an insulating material and the pair of first terminals 51 fitted in the first housing 11, where the first connector 1 is configured to be surface-mounted on an end of the top surface of the board 91 and has the first fitting face 11*a* extended in a direction (preferably, in a direction perpendicular to and) intersecting the top surface of the board 91; and the second connector 101 having the second housing 111 made of an insulating material and the second terminal 150 fitted in the second housing 111 and configured to make contact with respective first terminals 51 to electrically connecting the first terminals 51 to each other, where the second connector 101 is configured to be engaged with the first connector 1 and has the second fitting face 111*a* extended in a direction (preferably, in a direction perpendicular to and) intersecting the extending direction of the second terminal 150. The second housing 111 is provided with the second terminal accommodation-concave portion 114*a* which is configured to accommodate therein the second terminal 150; and, the second terminal 150 is provided with the pair of second terminal bodies 151 and the connecting portion 152 configured to connect respective second terminal bodies 151 together, where the second terminal bodies 151 are arranged to be perpendicular to the connecting portion 152 when the second terminal 150 is press-fitted into the second terminal accommodation-concave portion 114*a*.

Due to such a configuration, it is possible to positions each second terminal body 151 to be appropriately held and mutual connection of the first and second connectors 1, 101 to be stably maintained, thereby realizing a low height and miniaturization of a loop connector and a closed-circuit forming connector. Accordingly, it is possible to provide a loop connector and a closed-circuit forming connector which can be easily produced to have a simple structure and high reliability in operation with a small number of parts and low production costs.

Moreover, the second terminal accommodation-concave portion 114*a* is provided with the connecting portion accommodation-concave portion 114*b* that accommodate therein the connecting portion 152 and the pair of body accommodation-concave portions 114*d* that are arranged to be perpendicular to the connecting portion accommodation-concave portion 114*b* and accommodate therein the second terminal bodies 151, where each of the body accommodation-concave portions 114*d* comprising the small-width portion 114*n* are configured to correct the positioning of each of the second terminal bodies 151. Due to such a configuration, even when the second terminal bodies 151 are not processed to have a perfect 90 degree angle with respect to the connecting portion 152 by the bending process, the angle of the second terminal bodies 151 with respect to the connecting portion 152 can be corrected to be a perfect 90 degree angle when the second terminal 150 is press-fitted into the second terminal accommodation-concave portion 114*a*.

Furthermore, each of the body accommodation-concave portions 114*d* comprises the large-width portion 114*w* through which at least a portion of each of the second terminal bodies 151 is allowed to pass before the positioning thereof is corrected by the small-width portion 114*n*, where the small-width portion 114*n* has a width dimension smaller than that of the large-width portion 114*w*. Due to such a configuration, even when the second terminal bodies 151 do not have a perfect 90 degree angle with respect to the connecting portion 152, it is possible to insert the second terminal bodies 151 into the body accommodation-concave portions 114*d*.

Furthermore, each of the second terminal bodies 151 is provided with the second fixing portion 153 at the lower end thereof to which both ends of the connecting portion 152 are connected, the connecting portion accommodation-concave portion 114*b* being connected to the lower end of each of the body accommodation-concave portions 114*d*, and the small-width portion 114*n* being formed on the upper end of each of the body accommodation-concave portions 114*d* to accommodate therein the upper end portion 153*d* of the second fixing portion 153. Due to such a configuration, it is possible to correct the second terminal bodies 151 to have a perfect 90 degree angle with respect to the connecting portion 152 so that the second left and right terminal bodies 151 are arranged closely and in parallel to each other.

Moreover, the first housing 11 is provided with the first bottom plate portion 18 configured to oppose the top surface of the board 91, the second housing 111 is provided with the second bottom plate portion 118 configured to extend in the extending direction of the second terminals 150, and the projecting plate portion configured to procure the insulating distance between the first terminals 51 or the second terminals 150 is extended from the front end of the first bottom plate portion 18 or the second bottom plate portion 118. Due to such a configuration, the lower portions of the first terminals 51 or the second terminals 150 are covered, and accordingly, it is possible to procure a sufficient insulating distance between the first terminals 51 or the second terminals 150.

Furthermore, when the first connector 1 and the second connector 101 are engaged together, a portion of each of the first terminals 51 or the second terminals 150 are positioned right above a portion which is disposed between the front end of the first bottom plate portion 18 and the front end of the second bottom plate portion 118, and the projecting plate portion covers the lower portion of the portion of each of the first terminals 51 or the second terminals 150, disposed right above the portion between the front end of the first bottom plate portion 18 and the front end of the second bottom plate portion 118. Due to such a configuration, even when a conductive member is present between the front end of the first bottom plate portion 18 and the front end of the second bottom plate portion 118, it is possible to secure a sufficient insulating distance between the conductive member and the first terminals 51 or the second terminals 150.

While a preferred embodiment of the Present Disclosure is shown and described, it is envisioned that those skilled in the art may devise various modifications without departing from the spirit and scope of the foregoing Description and the appended Claims.

What is claimed is:

1. A loop connector comprising:

a first connector, the first connector including a first housing made of an insulating material and a pair of first terminals fitted into the first housing, the first connector being surface-mounted on an end of a top surface of a board and having a fitting face thereof extended in a direction intersecting the top surface; and a second connector (101) having, the second connector including a second housing made of an insulating material and a second terminal therein and configured to make contact with the first terminals, electrically connecting the first terminals to each other, the second connector engaging the first connector and having a fitting face thereof extended in a direction intersecting an extending direction of the second terminal;

wherein:

the second housing includes a second terminal accommodation-concave portion, configured to accommodate therein the second terminal; and the second terminal includes a pair of terminal bodies and a connecting portion configured to connect the terminal bodies together, the second terminal having a U-shape defined by the terminal bodies and the connecting portion, the terminal bodies arranged perpendicular to the connecting portion when the second terminal is press-fit into the second terminal accommodation-concave portion.

2. The loop connector according to claim 1, wherein the second terminal accommodation-concave portion includes a connecting portion accommodation-concave portion that accommodates therein the connecting portion and a pair of body accommodation-concave portions arranged perpendicular to the connecting portion accommodation-concave portion and accommodating therein the terminal bodies.

3. The loop connector according to claim 2, where each body accommodation-concave portion comprises a correcting portion configured to correct the positioning of each terminal body.

4. The loop connector according to claim 3, wherein each body accommodation-concave portion comprises a passage allowing portion, through which at least a portion of each terminal body is allowed to pass before the positioning thereof is corrected by the correcting portion.

5. The loop connector according to claim 4, where the correcting portion has a width dimension smaller than that of the passage allowing portion.

6. The loop connector according to claim 5, wherein each terminal body includes a fixing portion at a lower end thereof, to which both ends of the connecting portion are connected.

7. The loop connector according to claim 6, wherein the connecting portion accommodation-concave portion being connected to a lower end of each body accommodation-concave portion.

8. The loop connector according to claim 7, where the correcting portion is formed on an upper end of each body accommodation-concave portion to accommodate therein an upper end portion of the fixing portion.

9. A closed-circuit forming connector comprising:

a housing, the housing being made of an insulating material; and a loop terminal, the loop terminal being fitted into the housing and configured to make contact with counterpart terminals to electrically connect the counterpart terminals to each other, the closed-circuit forming connector engaging a counterpart connector and having a fitting face thereof extended in a direction intersecting an extending direction of the loop terminal;

wherein:

the housing includes a terminal accommodation-concave portion, configured to accommodate therein the loop terminal; and the loop terminal includes a pair of terminal bodies and a connecting portion configured to connect the terminal bodies together, the loop terminal having a U-shape defined by the terminal bodies and the connecting portion, the terminal bodies arranged perpendicular to the connecting portion when the loop terminal is press-fit into the terminal accommodation-concave portion.

10. The closed-circuit forming connector according to claim 9, wherein the terminal accommodation-concave portion includes a connecting portion accommodation-concave portion that accommodates therein the connecting portion and a pair of body accommodation-concave portions arranged perpendicular to the connecting portion accommodation-concave portion and accommodating therein the terminal bodies.

11. The closed-circuit forming connector according to claim 10, where each body accommodation-concave portion comprises a correcting portion configured to correct the positioning of each terminal body.

* * * * *